United States Patent [19]

Wheaton, III et al.

[11] 4,323,158

[45] Apr. 6, 1982

[54] BOTTLE NECK FINISH INSPECTION APPARATUS

[75] Inventors: Frank H. Wheaton, III, Millville; Curtis C. Houghton, Elmer, both of N.J.

[73] Assignee: Wheaton Industries, Millville, N.J.

[21] Appl. No.: 165,623

[22] Filed: Jul. 3, 1980

[51] Int. Cl.[3] ..... B07C 5/342

[52] U.S. Cl. ..... 209/524; 198/344; 209/538; 356/428

[58] Field of Search ..... 209/522, 523, 524, 525, 209/526, 538; 198/344, 379; 250/223 B; 356/428

[56] References Cited

U.S. PATENT DOCUMENTS

| | | | |
|---|---|---|---|
| 2,947,877 | 8/1960 | Stoate | 209/524 X |
| 3,327,849 | 6/1967 | Sorbie | 250/223 B X |
| 3,684,089 | 8/1972 | McMeekin | 209/538 X |
| 3,901,381 | 8/1975 | Quinn | 209/522 X |
| 3,944,058 | 3/1976 | Strauss | 198/344 X |
| 3,975,260 | 8/1976 | Peyton et al. | 209/524 |
| 3,991,883 | 11/1976 | Hobler et al. | 209/524 |
| 4,109,511 | 8/1978 | Powers, Jr. et al. | 209/538 X |

*Primary Examiner*—David A. Scherbel
*Assistant Examiner*—Edward M. Wacyra
*Attorney, Agent, or Firm*—Paul F. Prestia

[57] ABSTRACT

Glass bottle inspection apparatus including optical neck finish defect detector and mechanism for rotating the container or bottle to facilitate checking of the finish throughout its circumference. Gripping and rotation of the bottle or container is accomplished by a mechanism, adapted to any symmetrical shape, including non-round shapes, which comprises a resilient ring which is lowered vertically over the neck of the bottle or container to be checked when the bottle or container arrives at the test location of the apparatus. The resilient ring is engaged by a non-resilient annular ring which is in turn driven for rotational movement of the assembly. The elevating and lowering mechanism for the annular gripping ring also includes a downwardly biased bearing and flange member to urge the bottle out of engagement with the ring as the ring is raised, following checking.

8 Claims, 4 Drawing Figures

BOTTLE NECK FINISH INSPECTION APPARATUS

INTRODUCTION AND BACKGROUND

This invention pertains to glass bottle inspection apparatus and more particularly to apparatus for inspecting the neck finish of bottles, including particularly bottles of any symmetrical shape, including non-round bottles.

A wide variety of inspection apparatus has been devised for quality control of newly manufactured containers.

With respect to inspecting for defects in the neck finish of glass bottles, one common device utilizes an optical illumination and detector means focused at one point on the bottle neck together with a means for rotating the bottle and thus for checking the neck throughout its circumference. Defects in the neck finish of the bottle produce an output responsive electronic signal from the detector, which may be used to ring an alarm or automatically to reject the bottle. Known apparatus of this type utilizes a split concave gripping means near the bottom of the bottle to effect rotation thereof and is thus limited to round bottles.

It is therefore an object of the present invention to provide such neck finish inspecting apparatus adapted to grip and rotate glass containers or bottles of any symmetrical shape, including particularly non-round bottles.

It is therefore the general object of the present invention to provide such an apparatus and particularly to provide neck finish inspecting apparatus with a gripping means adapted to permit gripping and rotation of the bottle, regardless of the shape of the bottle, while permitting optical inspection of the neck finish or bottle "finish".

BRIEF DESCRIPTION OF THE INVENTION

This object and other related objects are met in accordance with the present invention, by an apparatus in which the bottle gripping and rotating means comprises a resilient ring which is lowered over the bottle shoulder and which is in turn engaged by a rotating member and a drive means to impart rotational movement to the member. This invention further includes means for lowering the grippping means over the bottle neck and raising the gripping means, while stripping the bottle therefrom, after the rotation and inspection of the bottle is complete.

In the preferred form of the present invention, the resilient gripping ring is engaged by an annular non-resilient rotating member at its outer edge and the annular rotating member is engaged by a drive means therefor. The annular rotating member and the inner resilient ring is in turn housed in a partially cut-away carrier which is associated with the mechanism for lowering and raising the gripping means. This mechanism in turn includes downwardly suspended roller bearings for stabilizing the bottle during rotation and, by downward biasing of an associated top flange, for automatically stripping the bottle from the gripping means as the gripping means is raised.

For a better understanding of the present invention, reference may be made to the detailed description of the preferred embodiment thereof which follows, taken in conjunction with the sub-joined claims and the drawings in which:

DETAILED DESCRIPTION OF THE PREFERRED EMBODIMENT

Figure 1:
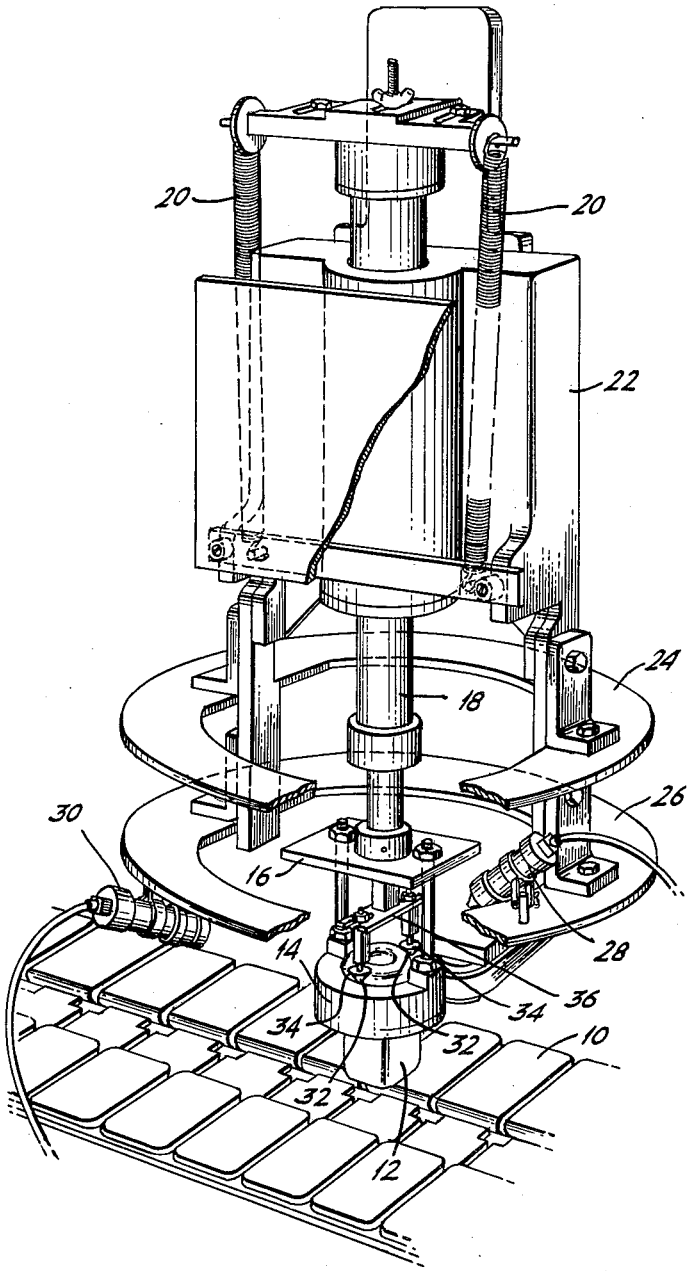
FIG. 1 is a perspective view of the assembled apparatus of this invention, taken together with the associated conveyor means by which bottles are conveyed to and from the apparatus.

Turning more specifically to FIG. 1, there is shown a conveyor 10, for delivering a sucession of bottles, of which one non-round such bottle 12 is shown in FIG. 1. Typically, such bottles would be delivered to and from the test apparatus of this invention in a succession of bottles at spaced intervals, maintained, for example, by a rotating worm spacer and facing rail just upstream of the test apparatus. The remaining equipment shown in FIG. 1 is the neck ring detecting apparatus of the present invention, in its preferred embodiment. This includes bottle gripping and rotating means carrier 14 suspended from and secured to a mounting platform 16 in turn attached to a gripping means elevating and lowering assembly 18 biased downwardly by springs 20 and upwardly moveable by a cam arrangement (now shown) in housing 22. Typically, the cam motion is stopped in a cam track in housing 22. Downwad movement of assembly 18 is permitted under the influence of springs 20 upon an indication, by means of a mechanical or electronic sensor (not shown), of the presence of bottle 12 at the test location of the apparatus. Similarly, upon completion of the rotational and checking movement of bottle 12, cam and housing 22 again raises assembly 18.

Also associated with housing 22 are mounting platforms 24 and 26, on which parts of the test device may be located, particularly including an optical illumination means 28 and optical checking means 30, both focused on a particular point of the neck ring of bottle 12. Upon rotation of bottle 12, checks, flaws or defects in the neck ring of bottle 12, anywhere in its circumference, is indicated by an output responsive electronic signal from detector 30, which signal may be used to sound an alarm or otherwise to reject, automatically or semi-automatically, the bottle in which the defect is indicated.

Also seen in FIG. 1, suspended downwardly from assembly 18, are a pair of roller bearings 32, adapted to engage the top outer surface of the neck of bottle 12 to stabilize the bottle during rotation thereof, and top flanges 34, adapted to engage the outer top surface of the neck of bottle 12.

Figure 2:
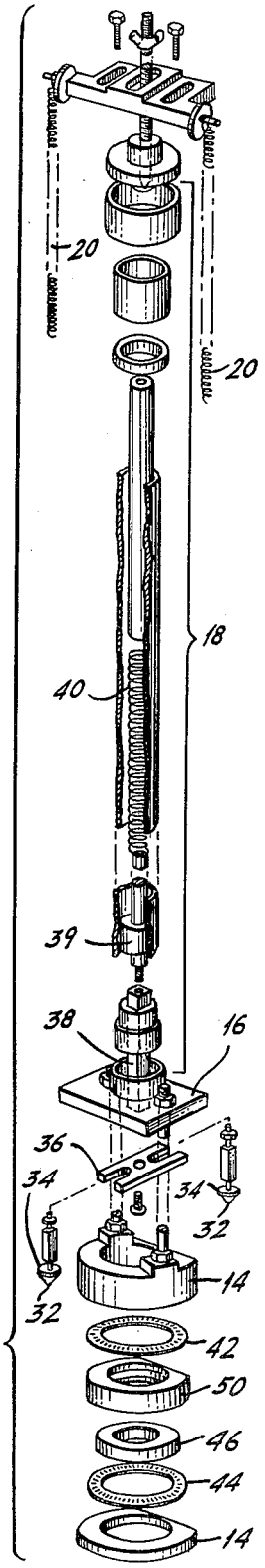
FIG. 2 is a perspective view, partially cut-away, of the main part of the invention, as shown in FIG. 1.

As better seen in FIG. 2, roller bearngs 32 and top flanges 34 are mounted to an adjustable centering holder 36, which permits adjustment of the spacing of roller bearings 32 and top flanges 34 to accommodate bottle necks of different diameters. Holder 36 is in turn retained at the bottom end of a separate shaft 38 within assembly 18 and shaft 38 is secured to a vertically independent insert 39, against which downward pressure is exerted by spring 40, so that roller bearings 32 and top flanges 34 are biased downwardly, with respect to assembly 18 and function to press bottle 12 downwardly as assembly 18 is raised, thereby to strip bottle 12 from the gripping means within carrier 14.

Figure 3:
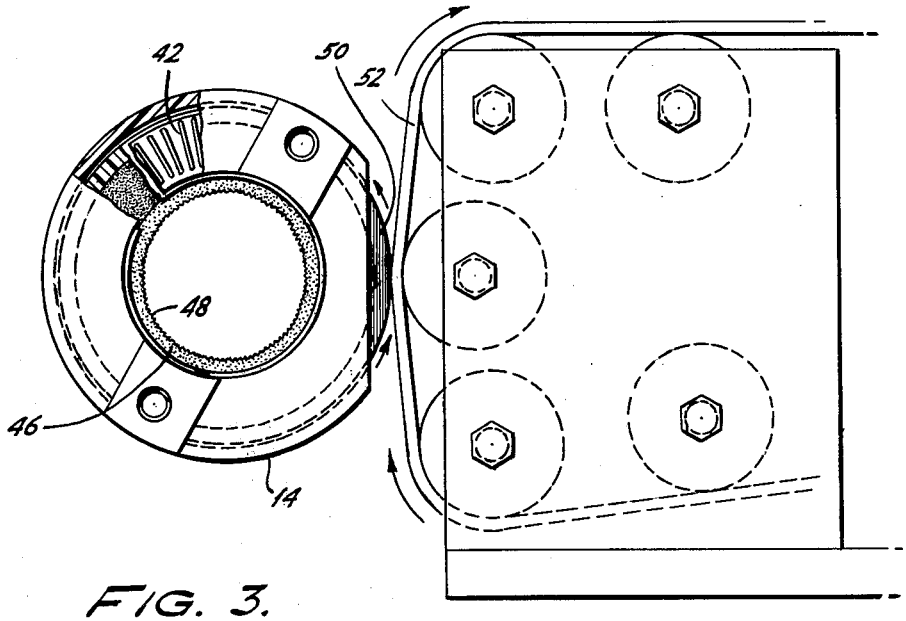
FIG. 3 is a plan view of the gripping means, rotating member and driving means of the preferred embodiment of the present invention, as seen in FIGS. 1 and 2.
Figure 4:
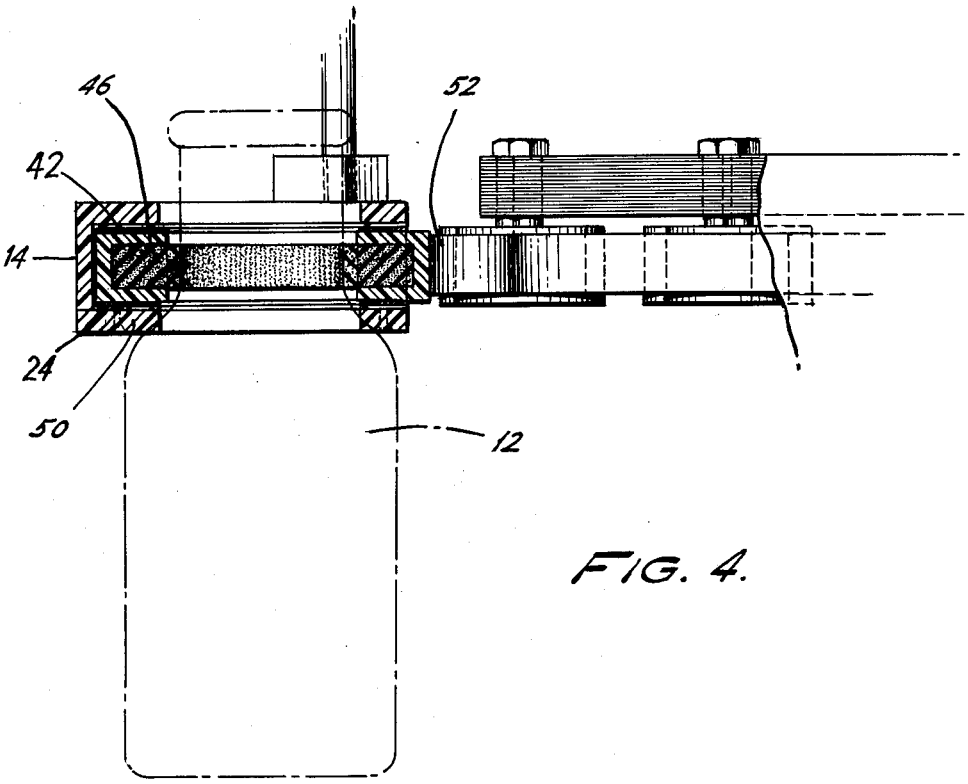
FIG. 4 is an elevation view of the gripping, rotating and driving means shown in FIG. 3, together with a bottle, as it would be gripped therein, shown in phantom.

The bottle gripping and rotating means within carrier 14 are shown in detail in the disassembled expanded view of FIG. 2 and in the elevation and plans views of FIGS. 3 and 4. There is shown more particularly carrier 14 and, housed in carrier 14, bearing rings 42 and 44 (to permit rotational movement of the other elements housed in carrier 14) and a resilient annular or ring-shaped bottle gripping member 46 with an inner surface 48 adapted to frictionally engage a bottle held therein. Gripping member or ring 46 is in turn engaged with a non-resilient annular outer member 50 which is rotatable and rotated by engagement with a driving means, such as friction surface rubber belt 52. As seen in FIG. 3, carrier 14 is cut away on one edge thereof to permit engagement of the drive means with the non-resilient annular rotating member 50.

In operation, upon the arrival of a bottle to be checked at the test location of the apparatus, assembly 18 lowers the gripping assembly within carrier 14 over the bottle neck, causing the gripping member 46 to grip the bottle below the top neck ring thereof, while permitting roller bearings 32 to engage the top outer surface thereof and the top flanges 34 to engage the outer top surface thereof. Engagement of rotating member 50 by driving means 52 then effects rotation of the frictionally gripped bottle in gripping member 46 and permits an output signal indication indicative of any defect or flaw in the neck ring of the bottle, as indicated by optical detector 30. Assembly 18 then raises the gripping assembly and carrier 14 while top flanges 34, spring biased downwardly, urge bottle 12 out of engagement with gripping member 46 as assembly 18 is raised, thus permitting bottle 12 to continue in its travel along conveyor 10.

While this invention has been described with reference to the preferred embodiment thereof, it should be understood that it is not limited thereto and the appended claims are intended to be construed to encompass the invention in its full spirit and scope and particularly to be construed to include all variants and modifications of the invention which may be devised by those skilled in the art without departing from the true spirit and scope thereof.

We claim:

1. In an apparatus for detecting defects in the neck portion of each bottle in a succession of glass bottles delivered to a bottle test location, said apparatus including:

means for receiving, holding and rotating each of said bottles as it is delivered to said test location, optical illumination and detecting means focused at one point on the neck of a bottle retained at said test location for detecting defects therein as said bottle is rotated and means responsive to a defect signal output from said illuminating and detecting to reject the bottle then retained at said test location, the improvement wherein said bottle receiving, holding and rotating means comprises:

an annular bottle gripping member adapted to fit around and to grip the neck finish of a bottle to be checked, means for lowering said annular gripping member from a raised position to a lowered position in which it is adapted to engage a bottle disposed in said bottle test location, means for rotating said annular gripping means in said lowered position, and means for raising said gripping member back to said raised position.

2. Improved apparatus, as recited in claim 1, wherein said annular bottle gripping member comprises a resilient ring with an inner ring surface adapted to frictionally engage the outer surface of a bottle to be checked below the top neck portion thereof.

3. Improved apparatus, as recited in claim 2, wherein said means for rotating said annular gripping member comprises a non-resilient annular member, engaged with said resilient ring gripping member outward of said inner ring surface, and drive means for imparting rotational movement to said rotating member.

4. Improved apparatus, as recited in claim 3, wherein said drive means comprises a friction surface drive belt adapted to engage the outer surface of said non-resilient annular member to impart rotational movement thereto when said gripping means is in its lowered position.

5. Improved apparatus, as recited in claim 3, wherein said ring gripping means and said annular rotating means are disposed and freely turnable within an annular carrier, cut away on one side thereof to facilitate engagement of said rotating means with said drive means.

6. Improved apparatus, as recited in claim 5, wherein said annular carrier is secured to and suspended from said raising and lowering means.

7. Improved apparatus, as recited in claim 6, wherein said raising and lower means also includes, suspended therefrom, a plurality of roller bearings adapted to engage the top outer surface of a bottle retained within said annular gripping member in a manner adapted to steady said bottle as it is rotated by said receiving, holding and rotating means.

8. Improved apparatus, as recited in claim 7, wherein said roller bearings are biased downwardly and include a top flange adapted to engage the outer top surface of a bottle engaged in said annular gripping member in a manner adapted to strip said bottle downwardly and out of engagement with said annular gripping member, as said annular gripping member is raised from its lowered position toward its raised position.

* * * * *